US005605233A

United States Patent [19]

Hauch

[11] Patent Number: 5,605,233

[45] Date of Patent: Feb. 25, 1997

[54] TROMMEL CLEANER

[75] Inventor: David A. Hauch, Afton, Minn.

[73] Assignee: Carter Day Industries Inc., Minneapolis, Minn.

[21] Appl. No.: 380,025

[22] Filed: Jan. 30, 1995

[51] Int. Cl.[6] ..... B07B 1/50

[52] U.S. Cl. ..... 209/385; 209/389; 241/74

[58] Field of Search ..... 209/379, 385, 209/386, 389, 390; 74/813 R, 572, 573 R, 608, 609, 612–616; 241/70, 74, 166, 167

[56] References Cited

U.S. PATENT DOCUMENTS

| | | | |
|---|---|---|---|
| 175,286 | 3/1876 | Hollingsworth | 209/390 X |
| 210,275 | 11/1878 | Teter | 209/386 |
| 227,883 | 5/1880 | Collins . | |
| 256,066 | 4/1882 | Stansfield . | |
| 309,716 | 12/1884 | Heine . | |
| 311,622 | 2/1885 | Wehner . | |
| 1,120,083 | 12/1914 | Rich . | |
| 1,361,051 | 12/1920 | Hamachek . | |
| 1,405,914 | 2/1922 | Hamachek . | |
| 2,478,246 | 8/1949 | Cortese et al. . | |
| 2,705,560 | 4/1955 | Bradshaw | 209/390 X |
| 2,802,570 | 8/1957 | Rapp et al. | 209/390 |
| 3,351,200 | 11/1967 | Burenga . | |
| 3,825,018 | 7/1974 | Ferraro . | |
| 4,234,413 | 11/1980 | Summers | 209/389 X |
| 4,325,717 | 4/1982 | Crowley, Jr. | 209/390 X |
| 4,469,230 | 9/1984 | Gorlitz et al. . | |
| 4,542,095 | 9/1985 | Jensen . | |
| 4,896,835 | 1/1990 | Fahrenholz | 241/74 |

OTHER PUBLICATIONS

Single parts drawing sheet showing trommel screen cleaner currently used and sold by assignee of the present inventor.

*Primary Examiner*—Karen B. Merritt
*Assistant Examiner*—Scott L. Lowe
*Attorney, Agent, or Firm*—Craig M. Gregersen; Briggs and Morgan

[57] ABSTRACT

A trommel cleaner apparatus having a non-circular rotatable shaft with a plurality of flapper elements mounted thereto for wiping and cleaning engagement with a trommel is provided herein. The flapper elements each have a hub having inner and outer surfaces, with the outer surface including a plurality of flappers extending therefrom so as to engage a trommel in cleaning operation and with the inner surface including a plurality of indexing lobes to variably position the flapper element relative to the shaft and adjacent flapper elements, thereby reducing the torque spikes applied to the trommel.

28 Claims, 4 Drawing Sheets

TROMMEL CLEANER

FIELD OF THE INVENTION

The present invention relates rotating trommels used to sort or size particulate matter in general and to an improved cleaner apparatus and drive system therefor used to clean the screens used in the trommel.

BACKGROUND OF THE PRESENT INVENTION

Rotating apparatus known as trommels have long been used to screen dirt, debris, and other undesirable material from desirable material as well as to sort or size particulate material, such as grains. In general, the trommels have a cylindrical configuration defined by a skeletal framework and one or more screen panels attached thereto. The screen panels each have a plurality of sorting (or sizing) holes or apertures therein that serve to pass particulate matter therethrough below a certain size range. The particulate matter is inserted into the trommel in one end thereof and, as the trommel rotates the undersized particles are passed through the holes into the appropriate collection apparatus disposed therebelow. In this manner, grain such as seed corn, oats, barley, etc. can be sorted according to size. Many times the materials are subjected to multiple sortings, sometimes within the same overall apparatus. In addition, there are several companies that place multiple trommels within a single unit, which will be referred to as a sizer hereafter.

As the material within the trommel rotates, particles slightly too large to pass through the apertures can become lodged therein. Within a very short time of beginning the sorting or sizing operation, the screen apertures can nearly all become completely obstructed, thereby preventing anymore material from passing therethrough and essentially ending the sorting operation as it begins. To prevent this from occurring, it is known in the art to use a variety of devices to clean the screen apertures as the screen is rotated. One such device uses a plurality of cylindrical rollers mounted on a shaft for free rotation relative thereto. The shaft is disposed above the trommel in such a manner that the rollers can rollingly engage the trommel. Friction between the trommel and the rollers causes the rollers to rotate as the trommel is rotated. The rollers are typically made of wooden or other suitable material. As the trommel rotates then, the rollers engage the portions of the particulate material extending through the sorting aperture and force the material out of the apertures and back into the interior of the trommel, thus opening the apertures so they can be used to sort material as intended. Another known type of screen cleaner utilizes an elongate cylindrical brush that cleans the screens by means of the brush bristles extending into the sorting apertures as the trommel rotates, forcing the material out of the apertures.

Still another form of trommel cleaner utilizes an elongate cleaner that includes a plurality, typically few in number, of flappers that extend outward from a central hub and into contact with the trommel. The flappers extend the length of the trommel and have a rectangular cross section. These units work well in cleaning the trommel screen, but are accompanied by several deficiencies. As the elongate flapper engages the trommel along its entire length, that is, as it slaps against the trommel, knocking the stuck material from the sizing holes, a torque spike is created that must be accommodated by the drive unit. Thus, a plurality of torque spikes equal to the number of flappers is created with each revolution of the trommel cleaner. These torque spikes necessitated the use of heavier elements than would otherwise be necessary in the drive system. In addition, the torque spikes most likely shortened the lifetime of all of the elements of the trommel system. Finally, this type of trommel cleaner requires a separate drive system to drive the cleaning unit. That is, they cannot be friction driven like the rollers and must have their own drive system comprising chains (or belts) and gears (or pulleys).

It would be desirable to have a trommel cleaner that provided the cleaning advantages of the flapper cleaners but that did not create the torque spikes found in such prior art cleaners.

SUMMARY OF THE INVENTION

It is an object of the present invention to provide new and improved apparatus that is not subject to the foregoing disadvantages.

It is another object of the present invention to provide an improved trommel cleaner that provides the cleaning advantages of the flapper-type cleaner but that does not create the torque spikes that those types of cleaners do.

It is still another object of the present invention to provide an improved trommel cleaner that includes a plurality of flapper elements that together extend substantially the length of the trommel.

It is yet another object of the present invention to provide an improved trommel cleaner of the flapper type that can be driven by a friction drive rather than a separate chain or belt drive.

It is still yet another object of the present invention to provide an improved trommel cleaning apparatus comprising a plurality of individual, substantially identical, flapper elements mounted to a shaft for rotation thereabout.

The foregoing objects of the present invention are provided by a trommel cleaner apparatus in accord with the present invention, the trommel cleaner having a shaft having a non-circular outer surface. The shaft mounts a plurality of flapper elements thereon. Each flapper element has a hub having an inner and outer surface. A plurality of indexing lobes extend inwardly from the inner surface of the hub. The indexing lobes and the non-circular shaft cooperate to enable adjacent flapper elements to be mounted to the shaft with flappers of one flapper element angularly disposed relative to the flappers of the adjacent flapper elements. In the embodiment shown in the Figures, the flapper element has five flappers disposed symmetrically about the hub such that the flappers extend outwardly from their bases which are in turn disposed about 72° apart. With eight indexing lobes as shown and a square shaft as shown, the flappers can be disposed about 9° apart. Thus, the torque spike is reduced because flappers will be striking along one eighth of the trommel compared to the entire length as with the prior art flapper cleaner. The torque spike is thus reduced to one eighth of that found in the prior art, thereby enabling the drive system for the trommel to be made of "lighter" components, enabling the trommel cleaner to be driven by a friction wheel engaged with the trommel, and lengthening the life span of all of the component parts due to the reduced torque that the trommel, the trommel drive and the trommel cleaner apparatus must bear.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
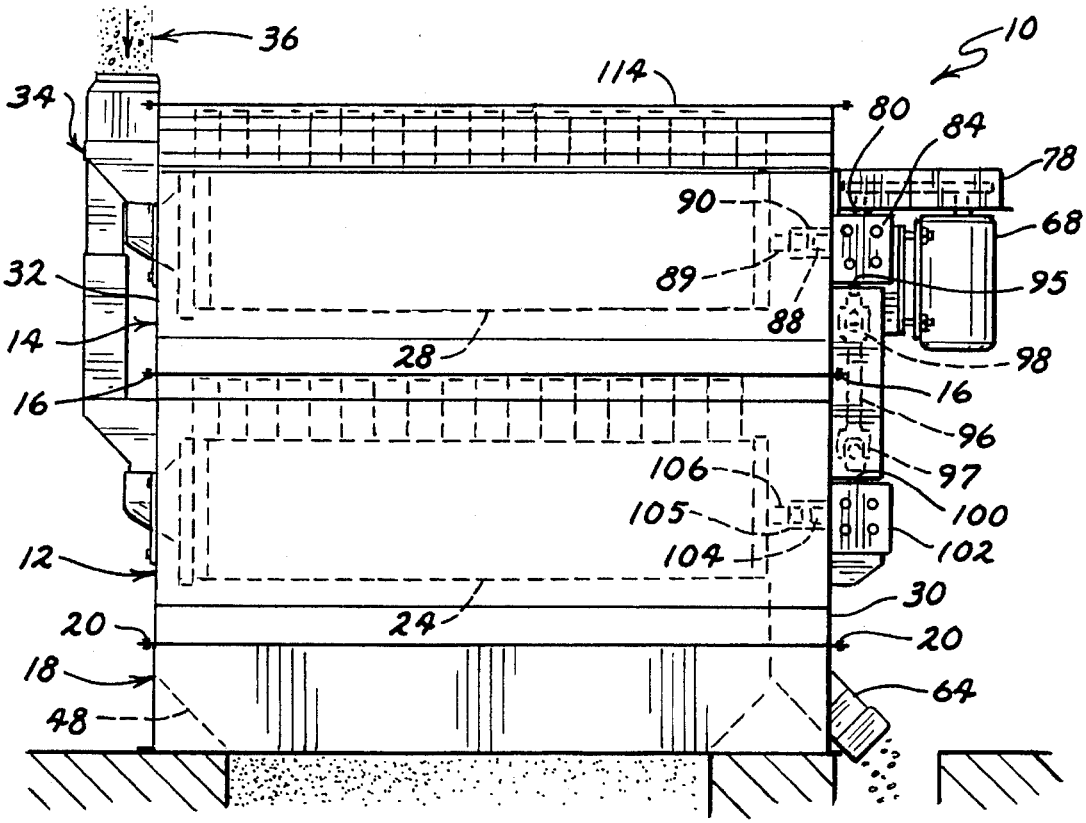
FIG. 1 illustrates a sizer in accord with the present invention in a side elevation, partial phantom view.
Figure 2:
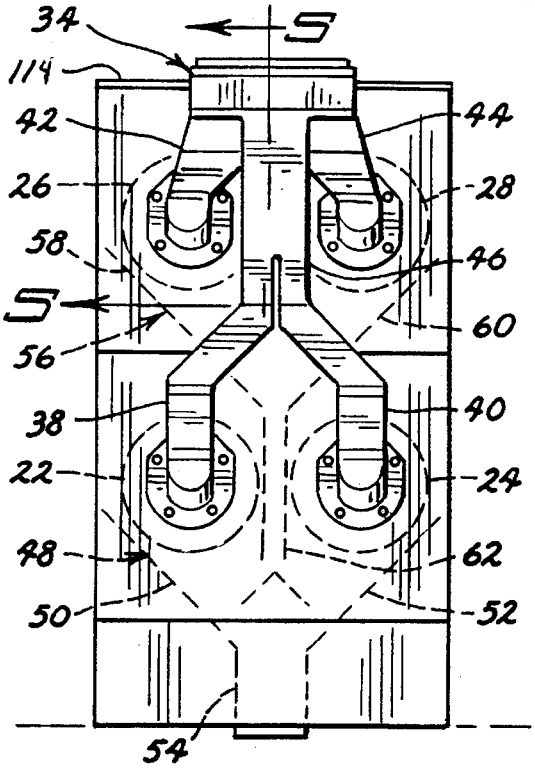
FIG. 2 shows the sizer of FIG. 1 in an end elevation view and illustrates the feeders for the rotating trommels contained therein.
Figure 3:
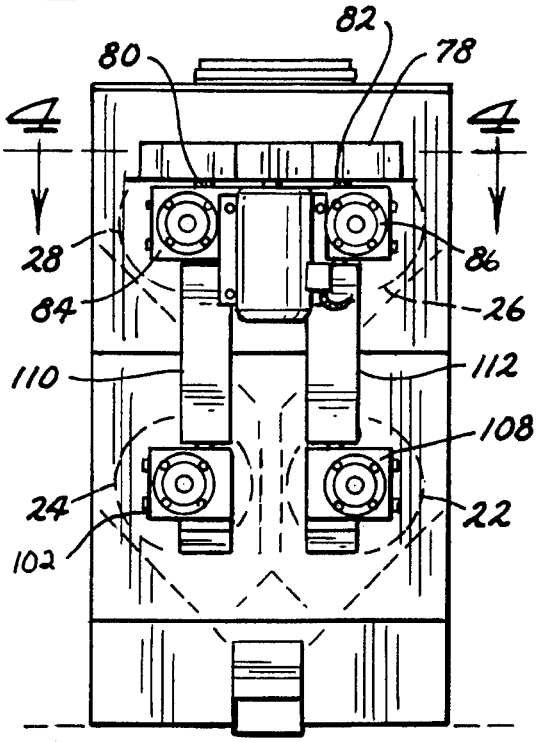
FIG. 3 depicts the sizer of FIG. 1 in an end elevation view from the other end and shows the drive mechanism for driving the rotating trommels.

Referring to FIG. 1, a sizer 10 in accord with the present invention is illustrated. Sizer 10 is used to sort undesirable from desirable particulate matter as well as to sort the particulate matter by size, such as the girth of a kernel of grain. As best seen in FIGS. 1–3, the sizer 10 illustrated includes four trommels arranged with two trommels side by side and directly over the other two. Sizers including one or more trommels are well known and the present invention is not limited to the present configuration shown herein.

As shown in the Figures, sizer 10 includes first and second, or lower and upper, modules 12 and 14. Modules 12 and 14 are attached to each other by fasteners 16, which may be nut/bolt combinations. Module 12 is in turn fastened to a base 18 by fasteners 20, which may also be nut/bolt combinations. Module 12 includes a pair of trommels 22 and 24 mounted side-by-side for rotation therein. Similarly, module 14 includes trommels 26 and 28 mounted in a side-by-side manner for rotation therein. Modules 12 and 14 have a substantially elongate, box-like configuration with the axis of rotation of the trommels defining the longitudinal direction. Transverse to the axis of rotation, the modules 12 and 14 each have a substantially rectangular configuration. Modules 12 and 14 each have an outer, four sided shell 30 and 32 respectively that mounts the trommels 22, 24 and 26, 28 therein, respectively. Shells 30 and 32 are typically manufactured from steel, though wood or other materials of suitable strength may appropriately be used.

Referring to FIGS. 1 and 2 particularly, now, it will be observed that sizer 10 includes a hopper 34 into which the particulate material 36 to be sorted is placed. Hopper 34 includes a plurality of branches therefrom that lead to the trommels within sizer 10. Thus, hopper 34 includes a branch 38 leading to trommel 22; a branch 40 leading to trommel 24; a branch 42 leading to trommel 26; and a branch 44 leading to trommel 28. It will be observed in FIG. 2 that hopper branches 38 and 40 are sub-branches of a larger main branch 46. The particulate matter 36 drops into hopper 34 and falls under the influence of gravity into branches 42, 44, and 46, and from branch 46 into branches 38 and 40. From the branches 38–44 the particulate matter flows into the trommels 22–28, respectively, in a known manner at the inlet ends thereof. Branches 38–46 may be formed of sheet steel or other appropriate materials.

Material passing through the trommel screens of trommels 22 and 24 is received by a receiving hopper 48. Hopper 48 has an elongate configuration with sloping side walls 50, 52 that converge near the bottom into an outlet channel 54, which in turn may empty into a conveyor (not shown). Similarly, material passing through the trommel screens of trommels 26 and 28 is received by an upper receiving hopper 56 that has sloping, converging side walls 58, 60 that empty into a channel 62. Channel 62 in turn empties the sorted material into lower receiving hopper 48. Material that does not pass through the screen openings in trommels 22–28 is carried through the trommels to the discharge ends thereof and discharged into a collection hopper 64, from which it flows into another conveyor (not shown). It will be understood that dependent upon the particulate matter 36 being screened or sized, that the material flowing into hopper 48 may be discarded or kept and that the same is true of the material flowing into hopper 64.

Figure 4:
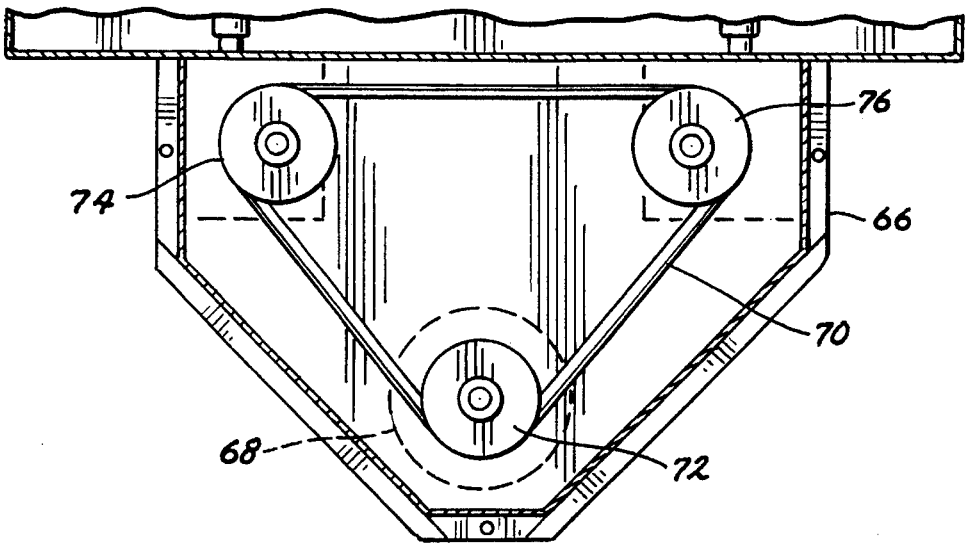
FIG. 4 illustrates in a top plan view taken along viewing plane 4—4 of FIG. 3 the drive belt and pulley system used to drive the rotating trommels.

Referring now to FIGS. 1, 3, and 4, the drive mechanism for the trommels will be explained. Upper module 14 includes a support plate 66 attached thereto in any known manner that extends outwardly therefrom. Support plate 66 has a substantially triangular configuration as shown, though this is not critical to the present invention. A drive motor 68 is suspended therefrom though it could also be supported thereabove if desired) and drivingly connected to a pulley 72 rotationally mounted to support plate 66. A drive belt 70 drivingly connects pulley 72 with a pair of pulleys 74, 76 that are also rotationally mounted to the support plate 66. An appropriate shield 78 is attached to the support plate 66 to shield the moving pulleys and belt.

Figure 5:
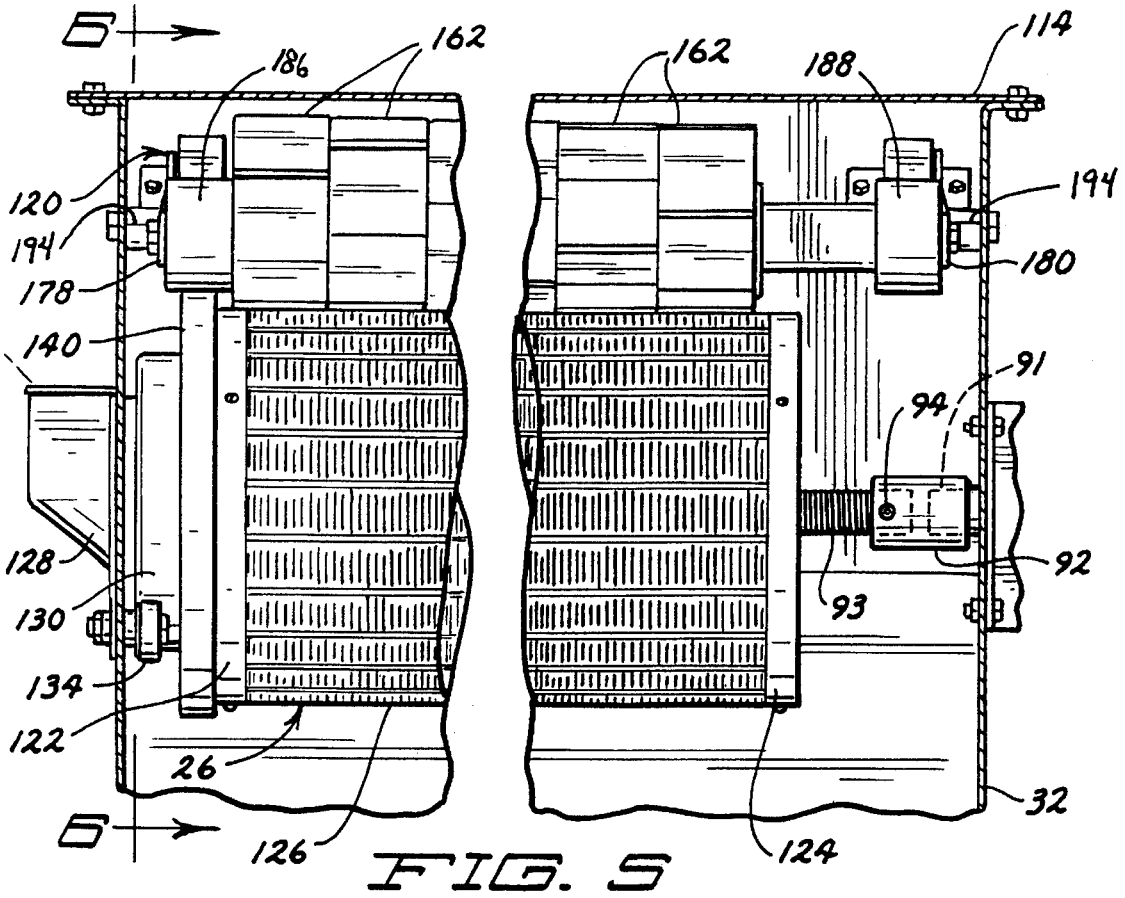
FIG. 5 is a cross sectional view taken along viewing plane 5—5 of FIG. 2.

Each pulley 74, 76 is drivingly attached to a drive shaft 80, 82, that extend through the support plate 66 into gear boxes 84, 86, respectively that are mounted to the shell 32 by known means such as bolting. A driven shaft extends at substantially a right angle from each gear box 84, 86 through the end wall of the shell 32 and engage a drive shaft that drives a trommel. Thus, referring to FIG. 1 in particular, it will be seen that a driven shaft 88 extends inwardly inside shell 32 from gear box 84 and is attached to a trommel drive shaft 89 of trommel 28 by means of a collar 90. Trommel 28 is thus driven by motor 68 through pulleys 72, 74 shaft 80, gear box 84 and shaft 88. A similar drive arrangement drives trommel 26. Referring briefly to FIG. 5 it will be seen that a driven shaft 91 extends through shell 32 from gearbox 86 into an open ended collar 92 that also receives the trommel drive shaft 93 of trommel 26. Both shafts 91 and 93 may be held in place with set screws 94 as shown. A similar form of attachment may be used to drivingly connect drive shafts 88 and 89 to each other.

Gear boxes 84 and 86 each have another stub drive shaft extending outwardly and downwardly therefrom. Thus, referring to FIG. 1, a stub shaft 95 is driven by gear box 84. Shaft 95 is attached to an intermediate shaft 96 having universal joints 97 and 98 at each end thereof. Shaft 95 is attached to U-joint 98. U-joint 97 is attached to a driven stub shaft 100 that is attached to and part of a gear box 102, which is mounted in any known manner, such as by bolting, to shell 30 of module 12. A right angle driven shaft 104 extends inwardly into shell 30 and is attached to a trommel drive shaft 106 of trommel 24 by a collar 105. A similar, though not shown drive arrangement is used to drive trommel 22 from a gear box 108. The intermediate drive shaft 96 and the intermediate drive shaft used to drive gear box 108 are each covered with appropriate shielding members 110, 112, respectively.

A further protective shield is cover 114 that is bolted to the upper module 14.

Referring principally now to FIGS. 5–8 a trommel and an improved trommel cleaner will be described. Each trommel 22–28 has its own cleaner, all of which are substantially similar. Thus, only trommel 26 and the trommel cleaner 120 for trommel 26 will be described, it being understood that the trommels 22, 24, and 28 and the cleaners for trommels 22, 24, and 28 are substantially similar.

Figure 6:
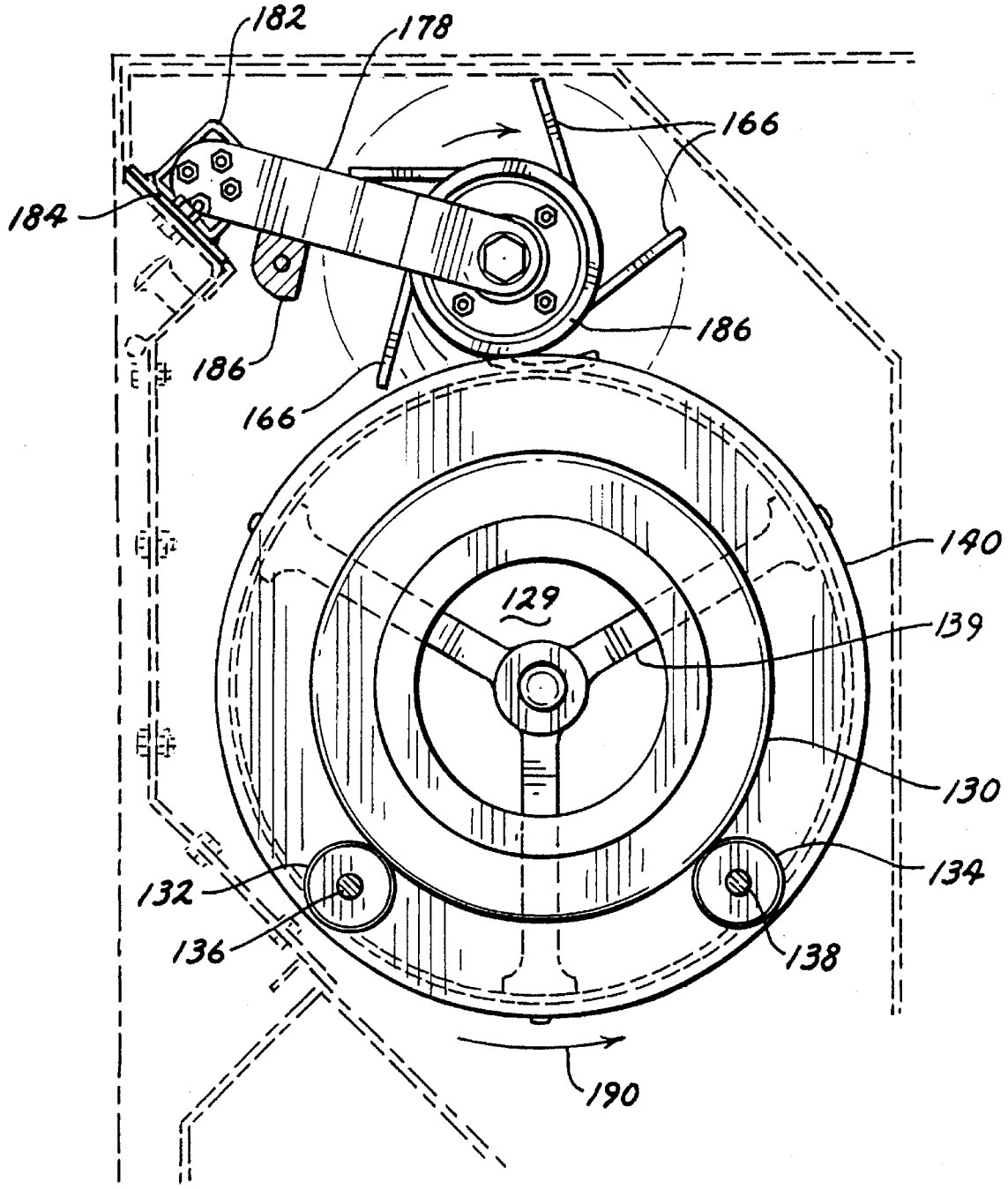
FIG. 6 is a cross sectional view taken along viewing plane 6—6 of FIG. 5
Figure 7:
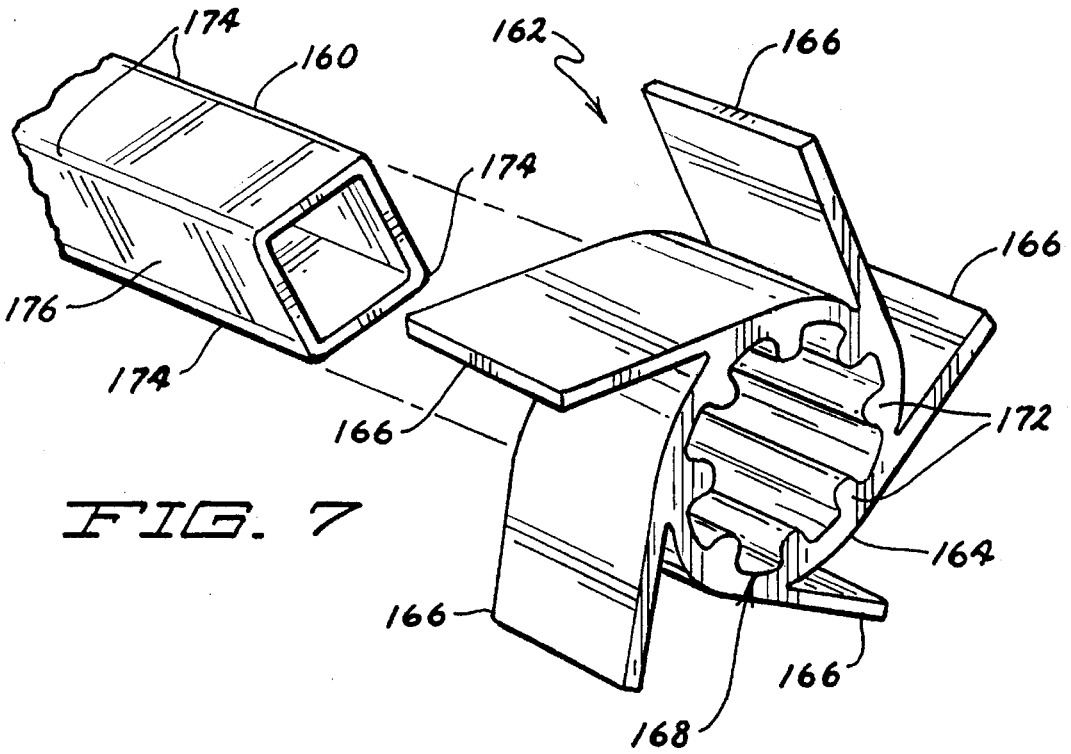
FIG. 7 is a partial perspective view of a drive shaft and flapper element in accord with the present invention.

Trommel 26 comprises a pair of end support rings 122, 124. Typically, though not shown, trommel 26 has longitudinally extending ribbing that extends between end support rings 122, 124 and cross bracing that extends across the interior of the trommel. Trommel 26 supports one or more screen panels 126 that may be attached to the end rings 122, 124 and the supporting structure in any known manner. A spout 128, which is attached to hopper branch 42, empties into the interior 129 of trommel 26. Referring briefly to FIGS. 5 and 6, it will be seen that the intake or input side of trommel 26 includes a wheel 130 that runs on a pair of spaced apart idler wheels 132, 134 that are rotationally mounted to the end wall of shell 32 by means of shafts 136, 138 respectively, which in turn are fastened thereto by a nut/bolt combination as best seen in FIG. 5. Wheel 130 is attached to a larger diameter running wheel 140, which in turn is attached to end ring 122. As discussed earlier, trommel 26 is rotationally driven by trommel drive shaft 93, which is in turn attached to a spider 139, best seen in FIG. 6, that is attached by known means such as bolts to the end ring 124.

Figure 8:
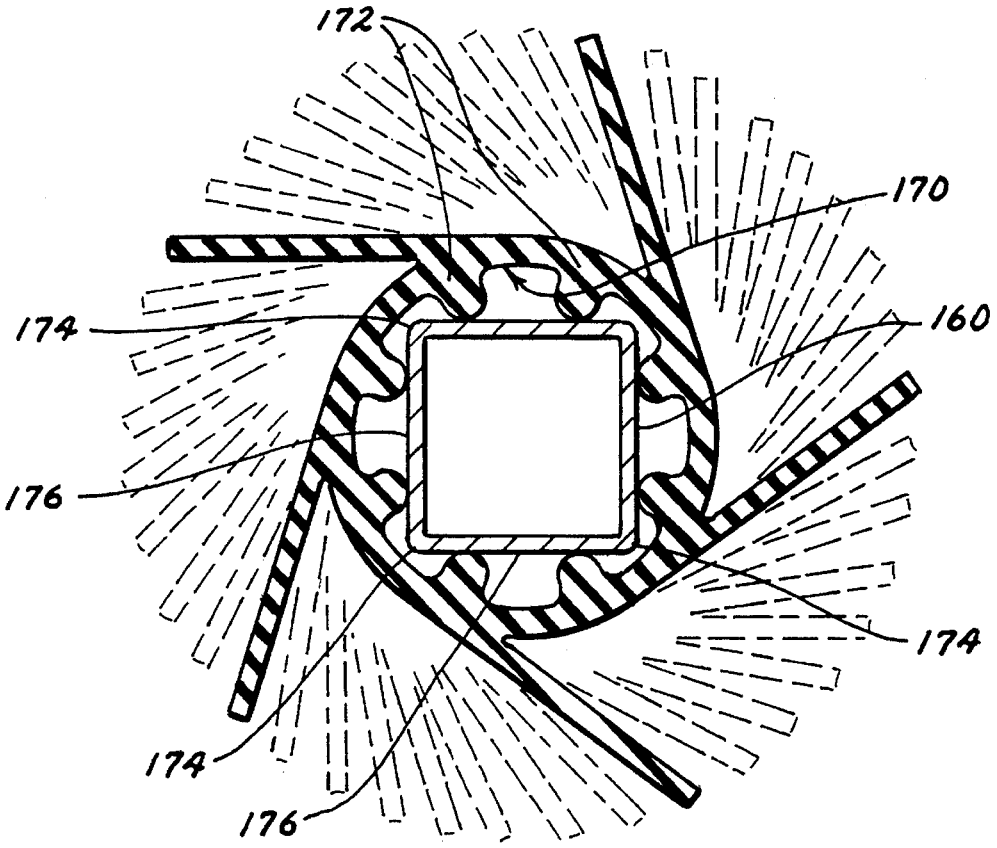
FIG. 8 is an end elevation, cross sectional and partial phantom view of a flapper unit in accord with the present invention.

Trommel cleaner 120 comprises a shaft 160 having a non-circular outer configuration that is square as shown in the Figures. Cleaner shaft 160 mounts a plurality of individual flapper elements 162, which may be made of urethane or any other suitable material. Each flapper element 162 comprises a hub 164 having a plurality of flappers or beaters 166 extending outwardly therefrom that are substantially equally spaced therearound. As best seen in FIG. 8, the flappers 166 extend away from hub 164 substantially tangentially thereto. Each flapper element has five such flappers 166 and thus the flappers 166 extend outwardly from the hub 164 approximately seventy two degrees (7°) apart and at an angle of approximately thirty degrees (30°) relative to a radius of the hub 164, the latter angle being variable within a range of about plus or minus five degrees (±5 ). Hub 164 has an inner or central passage 168 that receives shaft 160. Central passage 168 is defined by the inner surface 170 of the hub 164 and includes a plurality of indexing lobes 172 extending inwardly from the inner surface 170 toward the center of the hub 164. Referring to FIG. 8, it will be observed that the corners, that is, the longitudinally extending edges, 174 of shaft 160 are received between two adjacent indexing lobes 172 and that two lobes 172 bear against each side 176 of shaft 160. The flapper element embodiment shown in the Figures includes eight such indexing lobes. This enables each flapper element 162 to be mounted to shaft 160 in eight different positions. Thus, adjacent flapper elements are mounted such that they are rotated approximately forty-five degrees (45°) relative to the adjacent flapper elements. Since each flapper element 162 has five flappers 166 as shown, the flappers 166 of adjacent flapper elements are rotated approximately nine degrees (9°) relative to each other. FIG. 8 illustrates a flapper element 162 in cross section as well as shows in phantom outline the positions of other flappers down the shaft 160 and illustrates that the flappers are displaced approximately nine degrees relative to each other such that the flappers extend outwardly from the shaft 160 in forty different positions according to the present embodiment.

Consequently, the flappers 166 of the plurality of flapper elements 162 mounted to shaft 160 engage the trommel 26 five times with each revolution of shaft 160 but they do not do so at the same time as is the case with prior art longitudinally continuous flapper designs. That is, prior art flapper or beater cleaners included five longitudinally continuous flappers mounted circumferentially to a shaft. With each revolution of the shaft, each flapper would strike the trommel once along the entire length of the trommel, thereby creating five separate but large torque spikes. With the present embodiment shown in the Figures, the flappers 166 are striking substantially continuously along the trommel, but because of the ability to index the flapper element 162 relative to the shaft 160, the torque spike is reduced by a factor equal to the inverse of the number of indexing positions, which in this embodiment would be ⅛; that is, only one eighth of the flappers are forcefully engaging the trommel at any point in time. It should be noted once again that to achieve this reduction the number of flappers must be odd if the number of indexing positions is even and odd if the number of indexing positions is even. Were the number of lobes and flappers both even the pattern would begin to repeat too quickly and the advantages of indexing, while still useful, would be less so.

Dimensionally, in one embodiment, each flapper element hub 164 has a longitudinal extent within the range of about 2½ inches to about 3½ inches, and preferably is about three inches. The flappers 166 have a width equal to that of the longitudinal extent of the hub and a length of about 2 inches to about 2½ inches.

It will be noted that in the present embodiment as shown in the Figures that each flapper element has an odd number of flappers 166 and an even number of indexing lobes 172. Generally, the indexing and torque reduction provided by the present invention can be achieved by any combination of odd and even numbers of the lobes and flappers, though preferably the numbers of lobes and flappers would not be multiples of each other since that would reduce the benefits of the ability to index the flapper elements 162. That is, the number of flappers could be even and the number of indexing lobes could be odd and the torque reduction provided by the present invention will be achieved. Having both the number of lobes and the number of flappers be even, however, would provide for a rapid repetition of the positions of the flappers and therefore would not provide the dramatic torque reduction provided by the present invention. Similarly, where the number of flappers and lobes are multiples of each other, such as three and six or five and ten, the benefits of indexing will also be reduced.

The circumferential spacing of the flappers 166 about shaft 160 is shown in FIG. 8, thereby providing an indication of the reduction in the length of trommel being cleaned by the trommel cleaner at one time. Again, in the prior art, the entire longitudinal length of the trommel would be wiped by a flapper at one time. With the present invention, only one eighth of the trommel is being wiped at a time. The torque spike is therefore reduced by that same factor.

The reduction of the torque spike has consequences for the overall structure and configuration of the sizer 10. First is that the flapper trommel cleaner 120 can be driven by a friction wheel rather than requiring a separate chain, belt, or electric drive. Thus, as seen in FIGS. 5 and 6 the trommel cleaner 120 is mounted for rotation within the shell 32. More specifically, shaft 160 is rotationally mounted to a pair of arms 178, 180. Arms 178, 180 are in turn each mounted to a torsion block 182. Torsion block 182 is used to apply tension to the trommel cleaner 120 such that the flappers 166 forcefully engage the trommel. Torsion block 182 is attached to an inwardly extending flange 184, which is attached to the interior of the shell 32. Arms 178, 180 each engage a stop block 194 that is provided to limit the movement of the arms 178, 180 downwardly in the direction of the trommel 26.

More specifically yet, shaft 160 is mounted to a pair of friction wheels 186, 188, at each end thereof. Friction wheel 186 rotationally engages running wheel 140 formed at the end of trommel 26. Thus, as trommel 26 rotates counter-clockwise as indicated by arrow 190, trommel cleaner 120 will be rotated in a clockwise manner as indicated by arrow 192 through the frictional engagement of friction wheel 186 with running wheel 140. The flappers 166 of the flapper elements 162 will wipe across the trommel screens of trommel 26, dislodging particulate matter that may be lodged in the screen apertures.

As noted, in the embodiment shown, each flapper element 162 includes a plurality, here five, of lobes 172, that extend the entire longitudinal extent of the hub 164. The lobes 172 need not extend the entire length, though doing so helps strengthen the flapper element and spreads the stress felt by the lobes across a greater length. The lobes 172 have a substantially hemispherical cross section that transition into the inner surface area between the lobes with a somewhat wedge-shaped portion. Other cross sections may be used if desired. The inner surface 170 between the lobes 172 is substantially smooth and may be somewhat flat; that is, the surface 170 between the lobes 172 need not form a circular surface relative to the longitudinal axis of the hub 164.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. A trommel cleaner for cleaning a trommel, said trommel cleaner comprising:

a shaft having a non-circular cross section;

means for driving said shaft; and a plurality of flapper elements, each said flapper element comprising:

a hub having an interior and an exterior surface;

a plurality of flappers extending outwardly from said hub exterior surface for engaging the trommel; and a plurality of indexing lobes arrayed about said hub interior surface and engaging said non-circular cross section of said shaft.

2. The trommel cleaner of claim 1 wherein one of said plurality of flappers and said plurality of indexing lobes is even in number and the other of said plurality of flappers and said plurality of indexing lobes is odd in number.

3. The trommel cleaner of claim 1 wherein said plurality of flappers is five and said plurality of indexing lobes is eight.

4. The trommel cleaner of claim 1 wherein said plurality of flappers are integral with said hub.

5. The trommel cleaner of claim 1 wherein at least one of said plurality of flapper elements is manufactured from urethane.

6. The trommel cleaner of claim 1 wherein said trommel has a substantially cylindrical configuration and rotates during operation and wherein said means for driving said shaft comprises:

a friction wheel, said friction wheel rotatingly engaged with said trommel and rotating as said trommel rotates.

7. The trommel cleaner of claim 1 wherein said flapper elements are indexed about said shaft such that the flappers of at least a pair of adjacent flapper elements are angularly disposed relative to each other.

8. The trommel cleaner of claim 7 wherein said plurality of flappers is five and said plurality of indexing lobes is eight.

9. The trommel cleaner of claim 1 wherein said shaft has a square cross-section.

10. The trommel cleaner of claim 9 wherein at least one of said plurality of flapper elements has eight indexing lobes.

11. The trommel cleaner of claim 10 wherein said at least one of said plurality of flapper element has five flappers.

12. The trommel cleaner of claim 1 wherein:

said shaft has a square cross-section;

said plurality of flappers is five and said plurality of indexing lobes is eight; and said flapper elements are indexed about said shaft such that the flappers of adjacent flapper elements are angularly disposed relative to each other.

13. The trommel cleaner of claim 12 wherein said flappers of one of said flapper element are disposed at substantially nine degrees relative to the flappers of adjacent flapper elements.

14. The cleaner of claim 13 wherein said trommel has a substantially cylindrical configuration and rotates during operation and wherein said means for driving said shaft comprises:

a friction wheel, said friction wheel rotatingly engaged with said trommel and rotating as said trommel rotates.

15. A flapper element for a trommel cleaner comprising:

a hub having an interior and an exterior surface;

a plurality of flappers extending outwardly from said hub exterior surface; and a plurality of indexing lobes arrayed about said hub interior surface; wherein one of said plurality of flappers and said plurality of indexing lobes is even in number and the other of said plurality of flappers and said plurality of indexing lobes is odd in number.

16. The flapper element of claim 15 wherein said plurality of flappers is five and said plurality of indexing lobes is eight.

17. The flapper element of claim 15 wherein said flappers are integral with said hub.

18. The flapper element of claim 15 wherein said flapper element is manufactured from urethane.

19. The flapper element of claim 15 wherein said plurality of indexing lobes have a substantially semi-circular configuration and extend inwardly from said hub inner surface, a pair of said lobes defining a gap therebetween, said gap being provided for receiving a non-circular shaft extending through said hub.

20. The flapper element of claim 15 wherein said hub has a longitudinal extent within the range of about 2½ inches to about 3½ inches.

21. The flapper element of claim 15 wherein said hub has a longitudinal extent of about three inches.

22. The flapper element of claim 15 wherein said plurality of flappers have a length of about 2 inches to about 2½ inches.

23. The flapper element of claim 15 wherein said plurality of flappers extend away from said hub outer surface substantially tangentially relative thereto.

24. A process for reducing the stress on a trommel, wherein said trommel cleaner comprises a cleaner shaft and a plurality of flapper elements, each said flapper element including a hub and a plurality of flappers extending outwardly therefrom, said cleaner shaft being positioned relative to said trommel such that said flappers wipe said trommel during operation thereof said method comprising: providing a trommel;

indexing said flapper elements about said cleaner shaft such that flappers of at least a pair of adjacent flapper elements do not engage said trommel substantially simultaneously.

25. The process of claim 24 wherein said cleaner shaft has a non-circular cross-section having a plurality of corners and said hubs of said flapper elements include a plurality of lobes extending inwardly therefrom, said corners of said shaft being received between a pair of said lobes.

26. The process of claim 24 wherein said cleaner shaft has a non-circular cross section having a plurality of corners and further including providing at least one of said hubs with a plurality of indexing lobes to receive said cleaner shaft corners.

27. The process of claim 26 and further including providing said flapper elements with an even number of indexing lobes and an odd number of flappers.

28. The process of claim 26 and further including providing said flapper elements with an odd number of indexing lobes and an even number of said flappers.

* * * * *